United States Patent [19]

Allen et al.

[11] 4,453,352

[45] Jun. 12, 1984

[54] REFRACTORY BRICK WITH EXPANSION ALLOWANCE

[75] Inventors: Jim E. Allen, Pleasanton; Jacques R. Martinet, Danville, both of Calif.

[73] Assignee: Kaiser Aluminum & Chemical Corporation, Oakland, Calif.

[21] Appl. No.: 410,153

[22] Filed: Aug. 18, 1982

[51] Int. Cl.[3] ..... E04B 1/00

[52] U.S. Cl. ..... 52/98; 52/89; 52/573

[58] Field of Search ..... 52/232, 89, 575, 245, 52/603, 98, 573; 110/338, 339, 336; 432/251, 252

[56] References Cited

U.S. PATENT DOCUMENTS

| | | | |
|---|---|---|---|
| 1,191,271 | 12/1914 | Bow | 52/89 X |
| 2,186,223 | 1/1940 | Willetts | 52/232 |
| 2,192,642 | 3/1940 | Griffith | 52/270 |
| 3,139,048 | 6/1964 | Hall | 110/335 |
| 3,324,810 | 6/1967 | Neely | 110/338 |
| 3,346,248 | 10/1967 | Martinet | 52/89 X |
| 3,394,511 | 7/1968 | McKenna | 52/232 |

FOREIGN PATENT DOCUMENTS

| | | | |
|---|---|---|---|
| 18329 | 10/1980 | European Pat. Off. | 52/595 |
| 1551846 | 9/1979 | United Kingdom | 52/603 |

*Primary Examiner*—John E. Murtagh
*Assistant Examiner*—Kathryn L. Ford
*Attorney, Agent, or Firm*—Malcolm McQuarrie

[57] ABSTRACT

A refractory brick without a metal casing and having built-in expansion at the hot face is formed by having at least one side face divided into two sections, the section adjacent the cold face being of normal configuration, but the section adjacent the hot face being inclined at a greater angle to the opposed side face, whereby expansion allowance is provided at the hot face, the section adjacent the hot face also having at least one raised portion, preferably adjacent the hot face, the height of the raised portion being such that its surface lies substantially in the plane extended of the lower, cold face section. By this construction, a brick is provided with built-in expansion allowance at the hot face, substantial bearing surface at the cold face to prevent loosening of the refractory structure in use, and means to prevent inadvertent closing of the hot face thermal expansion allowance during placement of the brick in a kiln or furnace.

5 Claims, 2 Drawing Figures

REFRACTORY BRICK WITH EXPANSION ALLOWANCE

BACKGROUND OF THE INVENTION

This invention pertains to refractory brick and particularly such brick with built-in allowance for their thernal expansion when heated in service.

It is well-known that refractory brick expand when heated in service, and it is well-known to allow for this thermal expansion. When the refractory brick have metal plates on one or more of their faces, it is known to provide thermal expansion allowance by dimples, waves, or other collapsible configurations of the metal plate. Particularly, it is known to provide a greater amount of expansion allowance at the hot face of the brick by this means, for example as shown in U.S. Pat. Nos. 2,192,642 and 3,139,048.

However, not all refractory brick are used with metal plates, and when such plates are absent, other means have been used to provide for thermal expansion, for example by means of cardboard or asbestos strips. Again, it is known to provide greater expansion allowance at the hot face than at the cold face, for example as shown in U.S. Pat. No. 3,324,810.

However, the attachment of metal plates or cardboard or asbestos strips complicates the manufacturing process and makes it more expensive. Accordingly, the industry has been seeking for a simpler method of providing automatic thermal expansion allowance in refractory brick, particularly brick which are required to be free of metal casing, as is true in certain applications.

It has been suggested in U.S. Pat. No. 1,191,271 that thermal expansion allowance be provided in refractory brick by putting an increased taper on the brick adjacent the hot face. When such brick are put in place during construction of the furnace, there results a gap between the brick at their hot face ends, this gap being filled by expansion of the brick when the furnace or other structure is heated.

However, in constructing a furnace or kiln of the brick of U.S. Pat. No. 1,191,271 it is necessary to be very careful in laying them up, particularly in an arcuate construction such as a furnace roof or rotary kiln, that the brick are not tipped so that there is no gap at the hot face end of the brick, but a gap at the cold face end. Obviously, this erroneous method of installation destroys the presence of any thermal expansion space, and most probably will lead to broken or spalled brick when the furnace structure is heated. Because of this shortcoming of the brick of U.S. Pat. No. 1,191,271, they have found little use in practice.

The present invention is directed to the overcoming of this problem.

SUMMARY OF THE INVENTION

It has now been found, according to this invention, that a refractory brick free of metal casing and having built-in thermal expansion allowance which will be preserved without undue care in laying up the brick, is provided by a brick which has opposed generally rectangular top and bottom faces, opposed first and second end faces extending from the top to the bottom face, and opposed first and second side faces, wherein at least one of said side faces is divided into two sections, a lower section extending from the bottom face at least one-fourth the distance toward the top face and an upper section extending from the top face at least one-quarter the distance toward the bottom face, the upper section being at a slightly greater angle to the opposed side face than is the lower section and having at least one raised portion of a height such that the upper surface of the raised portion lies substantially in the plane of the lower section extended and of planar extent such that the total area of the raised portion is diminutive compared to the total area of ths side face on which it is located.

DETAILED DESCRIPTION

Figure 1:
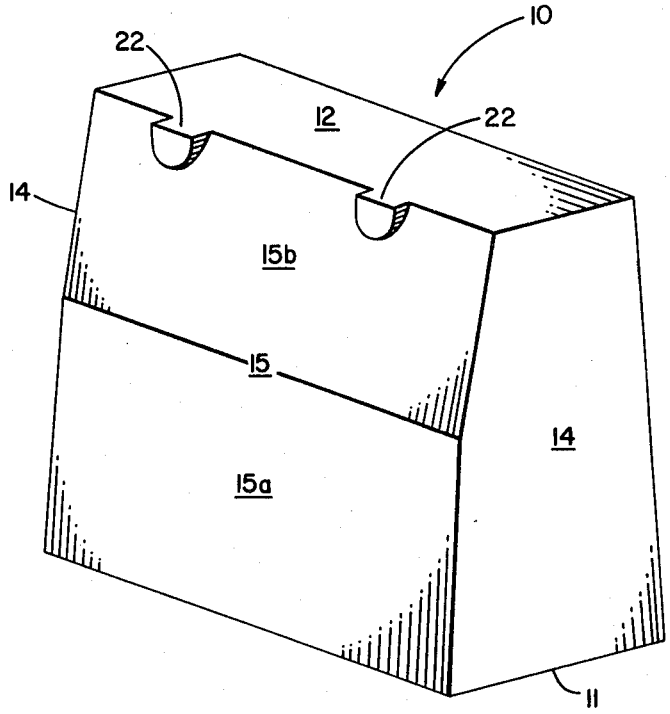
FIG. 1 is a perspective view of a refractory brick according to this invention.

The brick of the present invention may be based on a regular parallelopiped shape, such as would be used to construct a straight wall, but the invention finds particular application in brick intended to be used to construct an arcuate lining such as a sprung roof or the lining of a rotary kiln. In this latter case, the basic shape of the brick will be that of a wedge or taper.

The drawing illustrates this latter type of brick; while the description will be of such a basically tapered brick, it will be understood that the principles of the invention are equally applicable to a straight brick.

The brick 10 has six faces in opposed pairs, a bottom face 11 intended to be at the cold end of the brick, a top face 12 intended to be at the hot end of the brick, opposed end faces 14, of generally trapezoidal shape in the embodiment shown, but of rectangular shape in a straight brick, and first and second opposed side faces 15 and 16.

One of the side faces, face 15 in the configuration shown, is divided into two sections, a lower section **15*a* extending from bottom face 11 at least one-quarter, and preferably one-half, the distance toward hot face 12, and an upper section 15*b* extending at least one-fourth, and preferably one-half, the distance from hot face 12 toward cold face 11. In the configuration shown, section 15*a* is at a slight angle to side face 16, as is normal in tapered brick which are designed for turning a circle. Of course, in a straight brick configuration section 15*a* would be parallel to side face 16. The amount of convergence between 15*a* and 16** will, as is well understood in the art, be adjusted to obtain the turning arc desired for the particular application.

Figure 2:
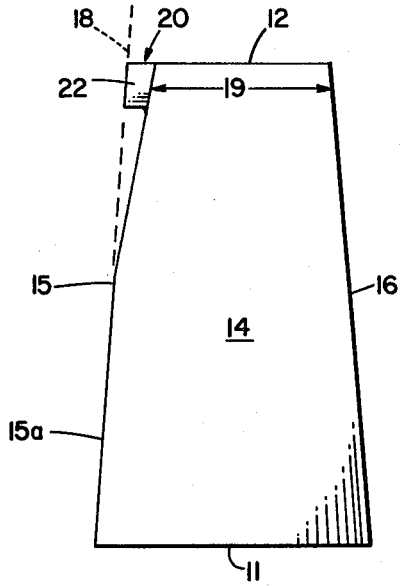
FIG. 2 is an end view of the brick shown in FIG. 1.

Section **15*b* is at a slightly greater angle to side face 16 than is Section 15*a*. The amount of this excess taper is adjusted to obtain the desired amount of thermal expansion allowance at face 12 when the brick is heated to the intended operating temperature. As will be evident from FIG. 2, the amount of expansion allowance is the distance between 15*b* at face 12 and line 18, representing the plane of Section 15*a* extended to face 12 of the brick. In the case of refractory brick made of periclase or periclase and chrome and intended to be heated to an operating temperature of 1400° C., a typical operating temperature for a rotary cement kiln, and having a dimension 19 of approximately 3" (7.6 cm), the thermal expansion space 20** will be about 1/32 of an inch (0.8 mm).

Somewhere in Section **15*b*, preferably at its edge adjacent to face 12, is at least one raised portion 22. As shown in the drawing, it is preferred to have two raised portions 22 to provide better stability in the structure. While clearly more than two raised portions 22 could be used, the total area of these portions 22, as will be discussed later, must be limited so as to be diminutive compared to the total area of face 15; accordingly, the larger the number of areas 22, the smaller the area of each, and consequently the greater difficulty in forming them in the brick. Accordingly, two such areas 22** appear to be optimum.

Raised areas 22 will be of such a height that their upper surfaces lie substantially in the plane of Section 15*a* extended, as indicated by line 18. Applying the previous specific example to raised area 22 at the edge of the brick as shown in the drawing, raised area 22 would have a height of 1/32 of an inch (0.8 mm). Obviously, if raised area 22 were closer to the center of face 15, its height would be less, so that its top surface still lay substantially in the plane of Section 15*a* extended; however, such configuration would be more difficult to manufacture than that shown.

As mentioned, the total area of raised portions 22 must be very small compared to the total area of side 15. This is because, while raised portions 22 are intended to hold the brick apart when they are first placed in the rotary kiln or other furnace structure, they must collapse and permit expansion of the brick at the hot face when the structure is heated. In a specific application of this invention, raised portions 22 were of area 0.35 sq. in. (0.54 sq. cm); two such raised portions were placed on a brick measuring 6"×9" (15×23 cm) on the face containing the raised portions. In this case, the raised portions amounted to 1.3% of the area of the face on which they were located. In general, it is preferred that the raised portions amount to no more than 5%, and preferably less than 2% of the total area of the face on which they are located. It will be evident to those skilled in the art that from the thermal expansion and strength characteristics of the refractory and the configuration of the kiln in which it is placed, it is possible to calculate the area of the raised portions required so that they will collapse under forces generated by thermal expansion of the structure.

The refractory brick of the present invention find application in any structure where refractory brick are used, but are particularly useful in lining a rotary kiln. Brick may be made of any known refractory material, but have proved particularly useful in brick made of relatively rigid refractory materials such as high purity periclase and high fired periclase-chrome brick.

As will be evident from the foregoing description, the brick of the present invention is designed so that when it is placed, for example, in a rotary kiln, there is zero thermal expansion allowance at the cold end of the brick, thereby providing a tight structure in which the brick will not loosen and fall out during operation of the kiln, while at the same time providing thermal expansion allowance at the hot face in a manner which does not require undue care in laying the brick in the kiln. While it would be possible to provide a single taper the full length of side 15, providing raised portions at the edge of side 15 adjacent side 12 to provide expansion allowance, such a structure would not provide the desired tight structure at the cold face, as is provided by lower Section 15*a*.

We claim:

1. In a refractory brick having opposed top and bottom faces, opposed first and second end faces extending from the top to the bottom face, and opposed first and second side faces, the improvement wherein at least one of said side faces is divided into two sections, a lower section extending from the bottom face at least one-fourth the distance toward the top face and an upper section extending from the top face at least one-quarter the distance toward the bottom face, the upper section being at a slightly greater angle to the opposed side face than is the lower section and having at least one raised portion of a height such that the upper surface of the raised portion lies substantially in the plane of the lower section extended and of planar extent such that the total area of the raised portion is diminutive compared to the total area of the side face on which it is located, whereby the raised portion is adapted to collapse and permit expansion of the brick when it is heated.

2. Refractory brick according to claim 1 wherein the total area of the raised portion is not over 2% of the total area of the side face on which it is located.

3. Refractory brick according to claim 1 wherein the raised portion is adjacent the intersection of the side face with the top face.

4. Refractory brick according to claim 1, 2 or 3 wherein the brick has two separate raised portions on one side face.

5. Refractory brick according to claim 4 wherein the lower section converges slightly toward the opposite side face from the bottom toward the top face.

* * * * *